US006363573B1

(12) United States Patent
Harsh

(10) Patent No.: US 6,363,573 B1
(45) Date of Patent: Apr. 2, 2002

(54) VACUUM CLEANER HEIGHT ADJUSTMENT MECHANISM

(75) Inventor: Kurt D. Harsh, North Canton, OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/525,779

(22) Filed: Mar. 15, 2000

Related U.S. Application Data

(63) Continuation of application No. 09/295,886, filed on Apr. 21, 1999, now Pat. No. 6,076,230.

(51) Int. Cl.[7] ..... A47L 5/34
(52) U.S. Cl. ..... 15/354
(58) Field of Search ..... 15/354, 355, 356, 15/368

(56) References Cited

U.S. PATENT DOCUMENTS 2,734,217 A * 2/1956 Ripple ..... 15/354 X
2,741,488 A * 4/1956 Brace ..... 15/354 X
3,821,831 A * 7/1974 Grover ..... 15/373
5,134,750 A * 8/1992 King et al. ..... 15/333
5,317,784 A * 6/1994 Glenn et al. ..... 15/356
5,467,502 A * 11/1995 Johnson et al. ..... 15/354
5,499,425 A * 3/1996 Glenn ..... 15/354
5,943,917 A * 8/1999 Truong et al. ..... 74/527
5,970,576 A * 10/1999 Maurer et al. ..... 15/354
5,974,625 A * 11/1999 Garner ..... 15/354

* cited by examiner

*Primary Examiner*—Chris K. Moore
(74) *Attorney, Agent, or Firm*—A. Burgess Lowe; Michael J. Corrigan

(57) ABSTRACT

A height adjustment mechanism for a vacuum cleaner includes a wheel carriage pivotally mounted to a foot of the vacuum cleaner, a height adjustment cam which engages the wheel carriage, and a cam actuator which attaches to the height adjustment cam for camming the height adjustment cam against the wheel carriage. The height adjustment cam is formed with a stepped bottom camming surface. The camming surface is formed with a plurality of spaced parallel ribs having a rounded outer surface which minimizes the surface-to-surface contact between the height adjustment cam and the wheel carriage. This reduced surface-to-surface contact reduces the frictional resistance between the height adjustment cam and the wheel carriage allowing the cam actuator to be easily slid for height adjustment of the vacuum cleaner foot.

18 Claims, 7 Drawing Sheets

VACUUM CLEANER HEIGHT ADJUSTMENT MECHANISM

This is a continuation of application Ser. No. 09/295,886 filed on Apr. 21, 1999 now U.S. Pat. No. 6,076,230, issued Jun. 20, 2000.

BACKGROUND OF THE INVENTION

1. Technical Field

The invention relates to vacuum cleaners. Particularly, the invention relates to a height adjustment mechanism for vacuum cleaners. Even more particularly, the invention relates to a height adjustment mechanism which includes a height adjustment cam formed with a ribbed camming surface for reducing the amount of force required to adjust the vacuum cleaner nozzle height.

2. Background Information

Because different types of carpets have different pile heights, conventional upright vacuum cleaners include variable height nozzles. A foot of these conventional uprights include some type of nozzle height adjustment mechanism which allows a user to adjust the height of the nozzle relative to a floor surface being cleaned.

Typically, these height adjustment mechanisms include a wheel carriage pivotally mounted to the foot of the upright vacuum cleaner. A height adjustment cam having a camming surface engages the wheel carriage and pivots the wheel carriage to raise or lower the height of the nozzle opening relative to the floor. The height adjustment cam is engaged by a cam actuator, such as a slide member, which is accessible from the outer surface of the foot. Such a height adjustment mechanism is shown and described in U.S. Pat. No. 5,134,750, assigned to a common assignee.

Although these prior art height adjustment mechanisms are adequate for the purpose for which they are intended, it is desirable to reduce the amount of force necessary to move the cam actuator to raise and lower the nozzle height. Such a reduction in force may be accomplished by reducing the surface-to-surface contact between the camming surface of the cam actuator and the wheel carriage. This reduced contact would reduce the amount of frictional resistance between the two members, thus requiring less force to operate the cam actuator.

Therefore, the need exists for a height adjustment mechanism which provides an easily operated cam actuator for raising and lowering the nozzle height relative to the floor surface.

SUMMARY OF THE INVENTION

Objectives of the invention include providing an improved height adjustment mechanism for a vacuum cleaner which reduces the amount of force required to operate the cam actuator as compared to prior art height adjustment mechanisms.

Another objective is to provide such a height adjustment mechanism which reduces the surface-to-surface contact between the height adjustment cam and the wheel carriage.

A further objective is to provide such a height adjustment mechanism which includes a plurality of predetermined nozzle heights.

A still further objective is to provide such a height adjustment mechanism which may be retrofit to existing upright vacuum cleaners These and other objectives will be readily apparent from the following description taken in conjunction with the accompanying drawings.

In carrying out the invention in one form thereof, these objectives and advantages are obtained by providing an improved height adjustment mechanism for a vacuum cleaner, said vacuum cleaner including a foot formed with a nozzle opening, a height of said foot being adjustable relative to a surface being cleaned, said height adjustment mechanism including a wheel carriage which engages the surface and supports a front of the foot thereon, said wheel carriage being movable to adjust the height of the foot, a height adjustment cam movably mounted on the foot and having a camming surface for engaging the wheel carriage, and a cam actuator connected to the height adjustment cam for moving said height adjustment cam, the improvement comprising a plurality of longitudinally extending ribs formed on the camming surface for reducing the surface-to-surface contact between the height adjustment cam and the wheel carriage.

BRIEF DESCRIPTION OF DRAWINGS

The preferred embodiment of the invention, illustrative of the best mode in which applicant has contemplated applying the principles is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
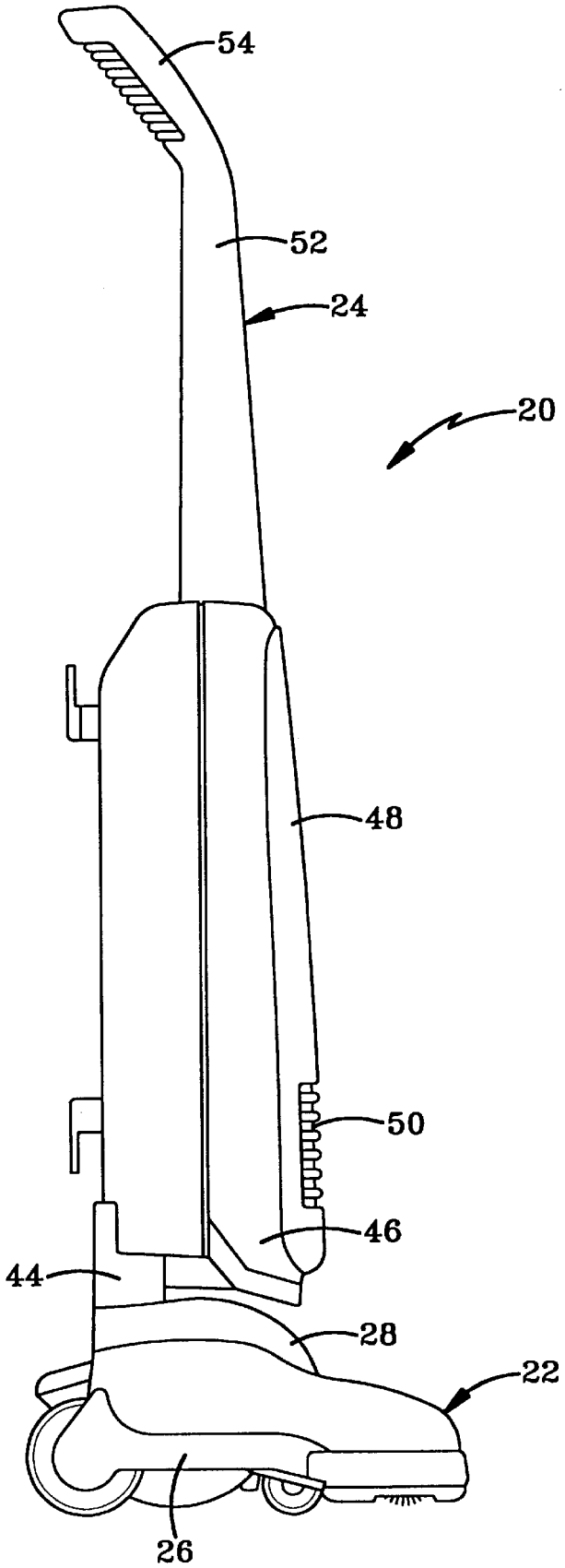
FIG. 1 is a side elevational view of an upright vacuum cleaner containing the nozzle height adjustment mechanism of the present invention.

An upright vacuum cleaner is shown in FIG. 1 and is indicated generally at 20. Upright vacuum cleaner 20 includes a foot 22 and an upper housing assembly 24 pivotally connected to foot 22. Foot 22 is similar to those known in the art and includes a base 26 which is covered by a top hood 28. Base 26 is formed with a nozzle opening 30 (FIG. 2) for receiving a stream of dirt-laden air. An agitator 32 is positioned within nozzle opening 30 and is formed with a pair of bristle rows 34 for agitating and loosening dirt, dust and debris from a floor surface. A bottom plate 36 is positioned on the bottom of base 26 and extends over nozzle opening 30. Bottom plate 36 is formed with a plurality of open areas 38 through which bristle rows 34 of agitator 32 extend to contact the floor surface and draw the dirt, dust and debris into nozzle opening 30. A pair of rear wheels 40 are rotatably mounted on the bottom of foot 22 for moving upright vacuum cleaner 20 across the floor surface.

Foot 22 is formed with a curved bottom surface 42 (FIGS. 1 and 2) which receives a motor-fan housing (not shown). The motor-fan housing houses a motor-fan assembly (not shown) which creates the suction necessary to remove the loosened dirt, dust and debris from the floor surface. The motor-fan assembly attaches to the upper housing assembly 24 by a dirt duct 44 (FIG. 1).

Upper housing assembly 24 houses a vacuum cleaner filter bag (not shown) for receiving and filtering the dirt-laden air stream which is created by the motor-fan assembly, and which is conveyed to the filter bag through dirt duct 44. Upper housing assembly 24 includes a rear housing 46 which forms a filter cavity for receiving the filter bag, a door 48 which encloses the cavity and which is formed with a plurality of exhaust slots 50, and an upper handle 52 which extends upwardly from rear housing 46 and which formed with a rearwardly angled hand grip 54.

In the illustrated preferred form of the present invention, foot 22 includes a height adjustment mechanism 60 (FIGS. 2 and 7–10) for adjusting the height of base 26, nozzle opening 30 thereof and bristle rows 34 relative to the floor surface. Height adjustment mechanism 60 is generally similar to that described in U.S. Pat. No. 5,134,750 assigned to a common assignee and incorporated herein by reference. Height adjustment mechanism 60 includes a wheel carriage 62 pivotally mounted to the bottom of foot 22, a height adjustment cam 80 and a cam actuator 140 (FIGS. 7–10).

Wheel carriage 62 includes a generally H-shaped bracket 64 (FIG. 2), a pair of sidewardly extending pintles 66 which mount within a pair of pivot pintle wells 68 formed in the bottom of base 26, an integral elongated tubular portion 70 formed on an end of bracket 64 opposite that of pintles 66 and an upwardly extending nose 72 (FIGS. 7–10). Nose 72 is formed with a rounded upper surface 74. An axle 76 (FIG. 2) extends within tubular portion 70 to rotatably support a pair of front wheels 78. Wheels 78 serve as the front wheels of upright vacuum cleaner 20 and are disposed rearwardly of agitator 32. Pintles 66 pivotally mount wheel carriage 62 to the bottom of base 26 whereby pivotal movement of wheel carriage 62 varies the height of base 26 and nozzle opening 30 thereof relative to the floor surface.

Height adjustment cam 80 is a one-piece member formed of a low friction plastic material, such as acetal. Height adjustment cam 80 is shown in detail in FIGS. 3–6 and includes a front 84, a rear 86, a first lower end 88, a second higher end 89, a top 90 and a bottom camming surface 92. A positioning arm 94 extends outwardly from higher end 89 and includes a positioning nub 96. Positioning nub 96 is received within one of a plurality of detents (not shown) formed in base 26 to retain height adjustment mechanism in an adjusted position. A pair of attachment arms 98, each of which is formed with a barbed end 100, extends upwardly from each of ends 88 and 89.

Figure 3:
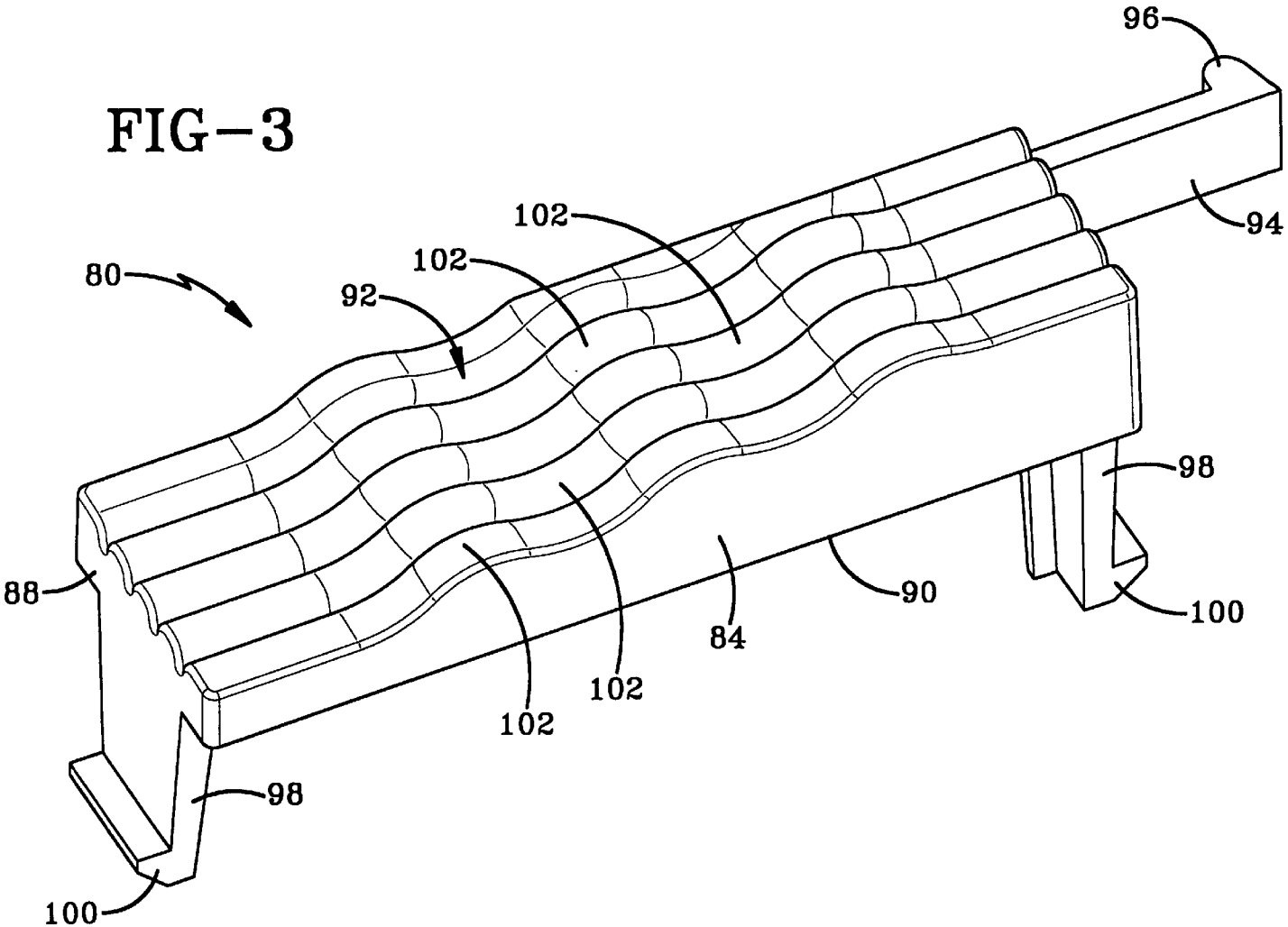
FIG. 3 is a perspective view of a height adjustment cam of the height adjustment mechanism.
Figure 4:
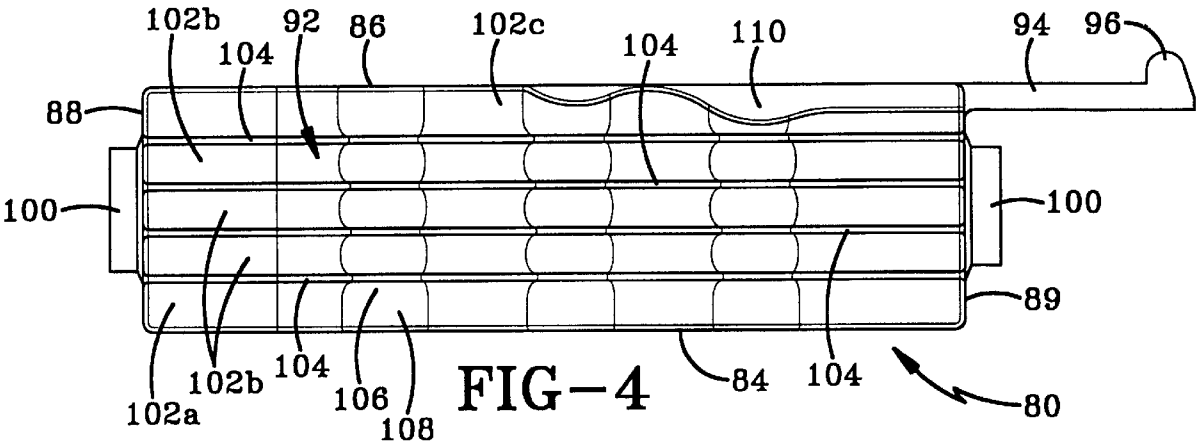
FIG. 4 is a bottom view of the height adjustment cam of FIG. 3.
Figure 5:
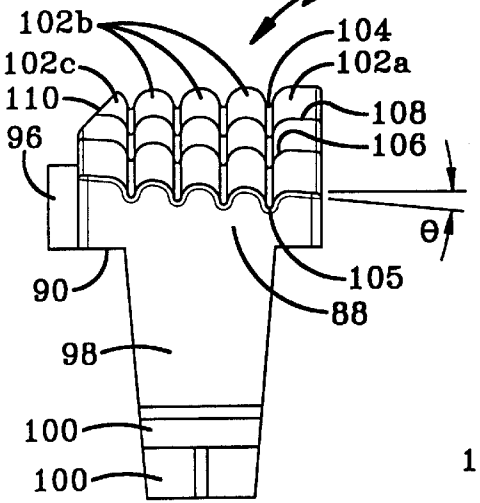
FIG. 5 is an end view of the height adjustment cam of FIG. 4.

In the shown preferred embodiment of the invention, bottom camming surface 92 is formed with a plurality of spaced parallel ribs 102 (FIG. 3). Ribs 102 are separated from one another by one of a plurality of grooves 104 which are formed in camming surface 92. Although any number of ribs 102 and grooves 104 may be formed on camming surface 92, in the shown preferred embodiment, five ribs 102 are formed on camming surface 92 separated by four grooves 104. Grooves 104 are formed with a rounded inner surface 105. Ribs 102 include a front rib **102*a* (FIGS. 4 and 5), three middle ribs 102*b* and a rear rib 102*c*. Front and rear ribs 102*a* and 102*c*, respectively, include a rounded inner corner 106 and a substantially flat outer surface 108 (FIGS. 4 and 5). Rear rib 102*c* is formed with a substantially flat angled outer rear edge 110 which tapers from higher end 89 to lower end 88. Middle ribs 102*b* are formed with a rounded outer surface 112** which has a radius of between 0.04 R to 0.06 R, and preferably has a radius of approximately 0.056 R.

Figure 8:
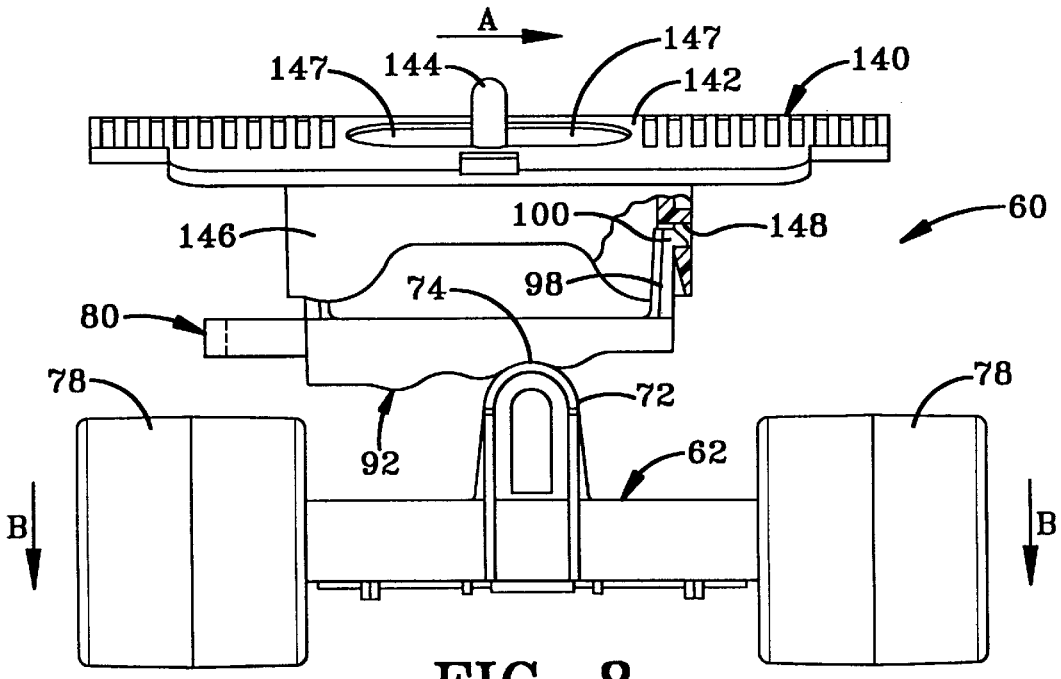
FIG. 8 is a front elevational view similar to FIG. 7 showing the height adjustment mechanism in a second height setting.
Figure 9:
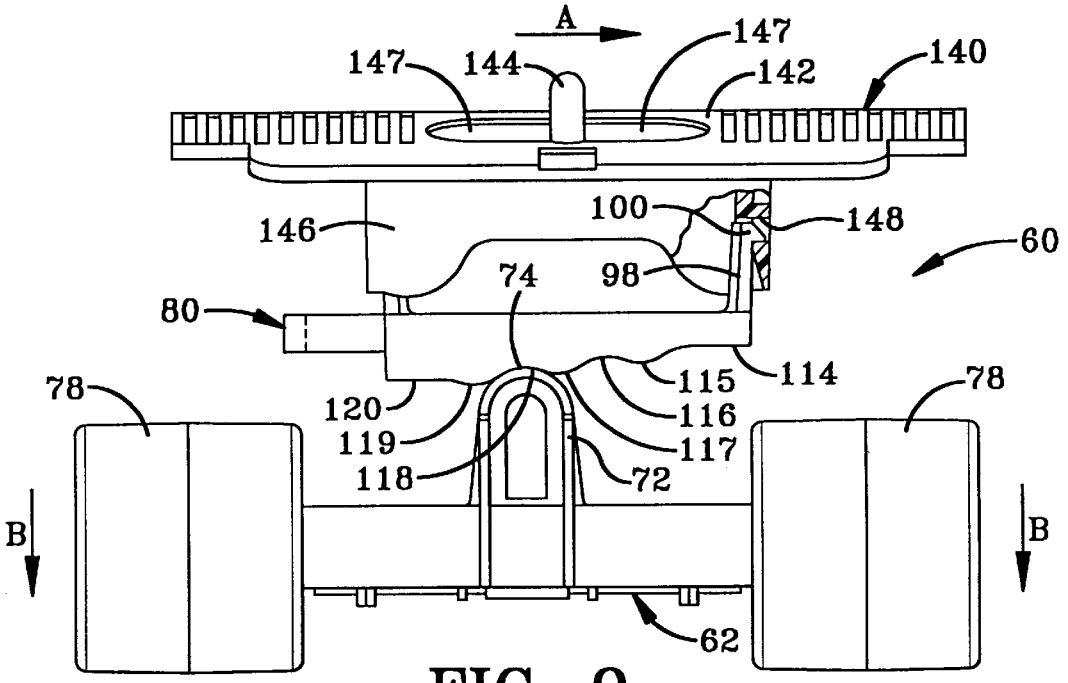
FIG. 9 is a front elevational view similar to FIG. 8 showing the height adjustment mechanism in a third height setting.

Camming surface 92 is stepped from lower end 88 to higher end 89 (FIG. 6) to form a plurality of predetermined height adjustment settings. Camming surface 92 is formed with a flat first height adjustment surface 114 (FIG. 6) at lower end 88, a concave second height adjustment surface 116, a concave third height adjustment surface 118, and a flat fourth height adjustment surface 120 at higher end 89. First and second height adjustment surfaces 114 and 116, respectively, are separated by a first rounded raised projection or step 115. Second and third height adjustment surfaces 116 and 118, respectively, are separated by a second rounded raised projection or step 117. Third and fourth height adjustment surfaces 118 and 120, respectively, are separated by a third rounded raised projection or step 119. Concave surfaces 116 and 118 are generally complementary in shape to rounded upper surface 74 of nose 72 allowing nose 72 to sit therein, as shown in FIGS. 8 and 9, when height adjustment mechanism 60 is moved to the second or third height settings.

Figure 6:
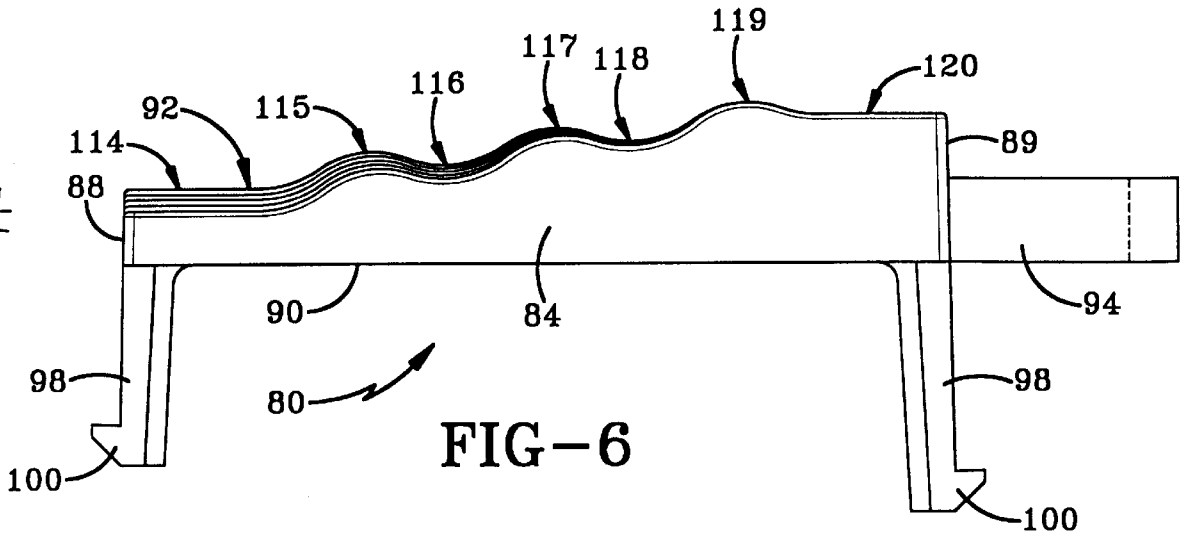
FIG. 6 is a front elevational view of the height adjustment cam of FIG. 5.

Bottom camming surface 92 is sloped or angled downwardly from front 84 to rear 86 of height adjustment cam 80 (FIGS. 3 and 6). Camming surface 92 has an angle θ (FIG. 5) of between 0.5 degrees and 1.5 degrees at higher end 89 of height adjustment cam 80, and preferably has an angle θ of approximately 1.1 degrees at higher end 89. The angle of camming surface 92 gradually increases from higher end 89 to lower end 88 whereby camming surface 92 has an angle θ of between 4.5 degrees and 5.5 degrees at lower end 88 of height adjustment cam 80, and preferably has an angle θ of approximately 5.1 degrees at lower end 88.

Cam actuator 140 is disposed on an upper surface of base 26 of foot 22 and includes a slide plate 142 (FIGS. 7–10), an adjustment knob 144 and a bottom latching member 146. Adjustment knob 144 extends upwardly from slide plate 142 and is accessible through hood 28 of foot 22. A recessed area 147 is formed on either side of adjustment knob 144 for receiving a user's finger during adjustment of height adjustment mechanism 60. Latching member 146 extends downwardly from slide plate 142 and is formed with a pair of openings 148 in either end thereof. Openings 148 receive barbed ends 100 of attachment arms 98 to secure cam actuator 140 to height adjustment cam 80, as described below.

Figure 2:
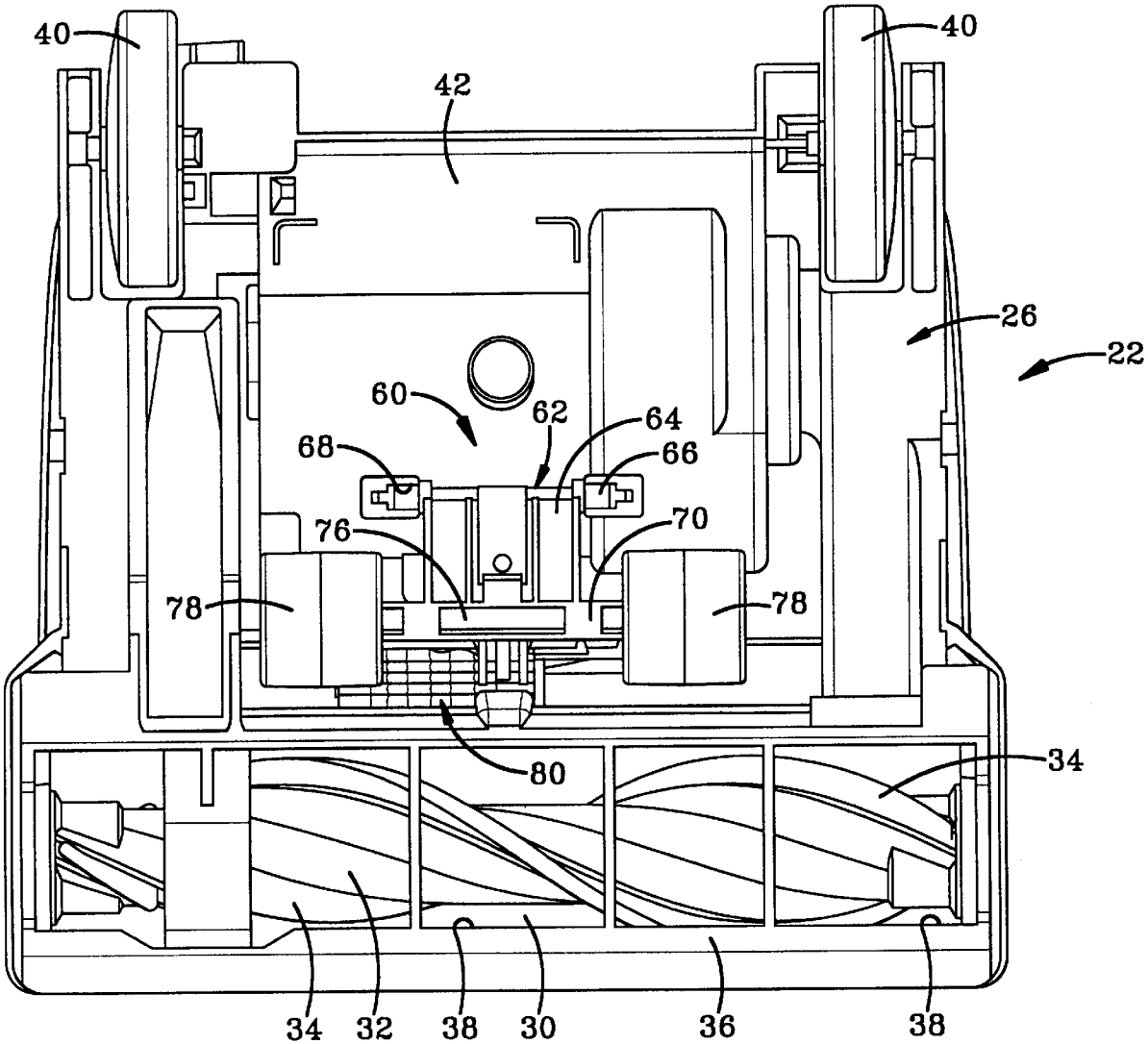
FIG. 2 is a bottom view of the foot of the upright vacuum cleaner of FIG. 1.

Height adjustment mechanism 60 is assembled by inserting pintles 66 within pintle wells 68 to pivotally mount wheel carriage 62 to the bottom of base 26 (FIG. 2). Height adjustment cam 80 and cam actuator 140 are aligned with a sidewardly extending slotted opening (not shown) formed in hood 28 to allow barbed ends 100 of attachment arms 98 of height adjustment cam 80 to extend through the opening and engage openings 148 of latching member 146. Height adjustment cam 80 and cam actuator 140 sandwich base 26 therebetween. Adjustment knob 144 will extend through the sidewardly extending opening of hood 28 and is accessible from the outer surface of hood 28 (FIG. 1).

Figure 7:
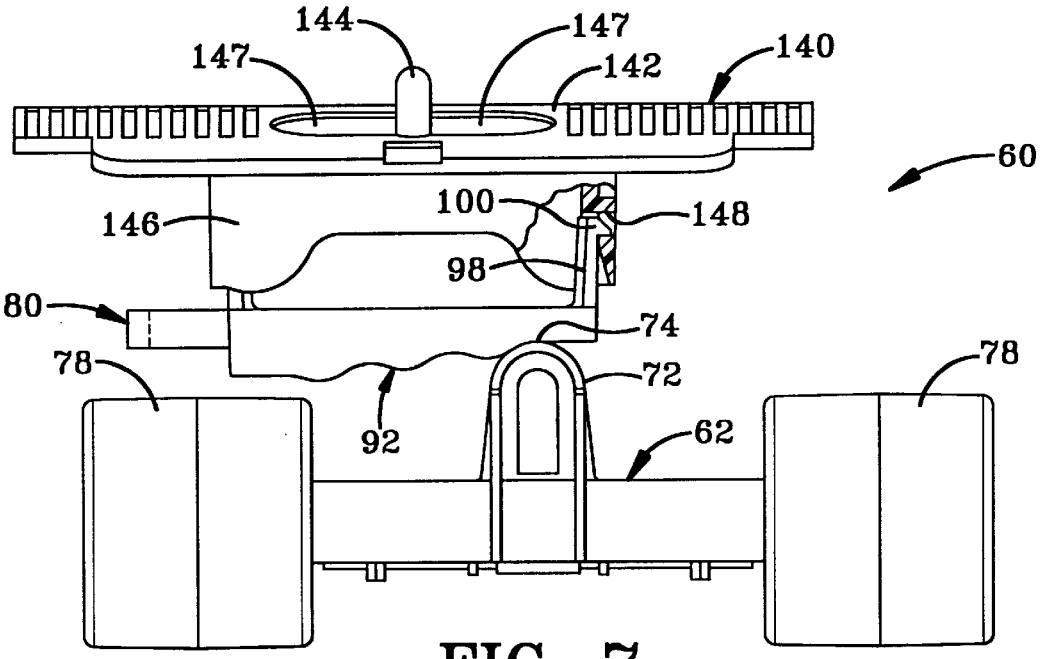
FIG. 7 is a front elevational view of the height adjustment mechanism shown in a first height setting.

When vacuum cleaner 20 is placed on the floor, the weight of foot 22 will cause wheel carriage 62 to pivot upwardly forcing nose 72 of wheel carriage 62 to contact camming surface 92, as shown in FIG. 7. Nose 72 is positioned on first height adjustment surface 114 in FIG. 7, placing height adjustment mechanism 60 in the first or lowest height setting whereby nozzle opening 30 is closest to the floor surface.

To place height adjustment mechanism in the second height setting, height adjustment knob 144 is slid or displaced in the direction of arrow A (FIG. 8), causing rounded upper surface 74 of nose 72 to cam against first raised projection 115. Height adjustment knob 144 slides until nose 72 sits within concave second height adjustment surface 116. Wheel carriage 62 pivots downwardly in the direction of arrow B to raise foot 22 and nozzle opening 30 thereof to the second height setting. Nub 96 of positioning arm 94 rests within a second aligned detent (not shown).

Figure 11:
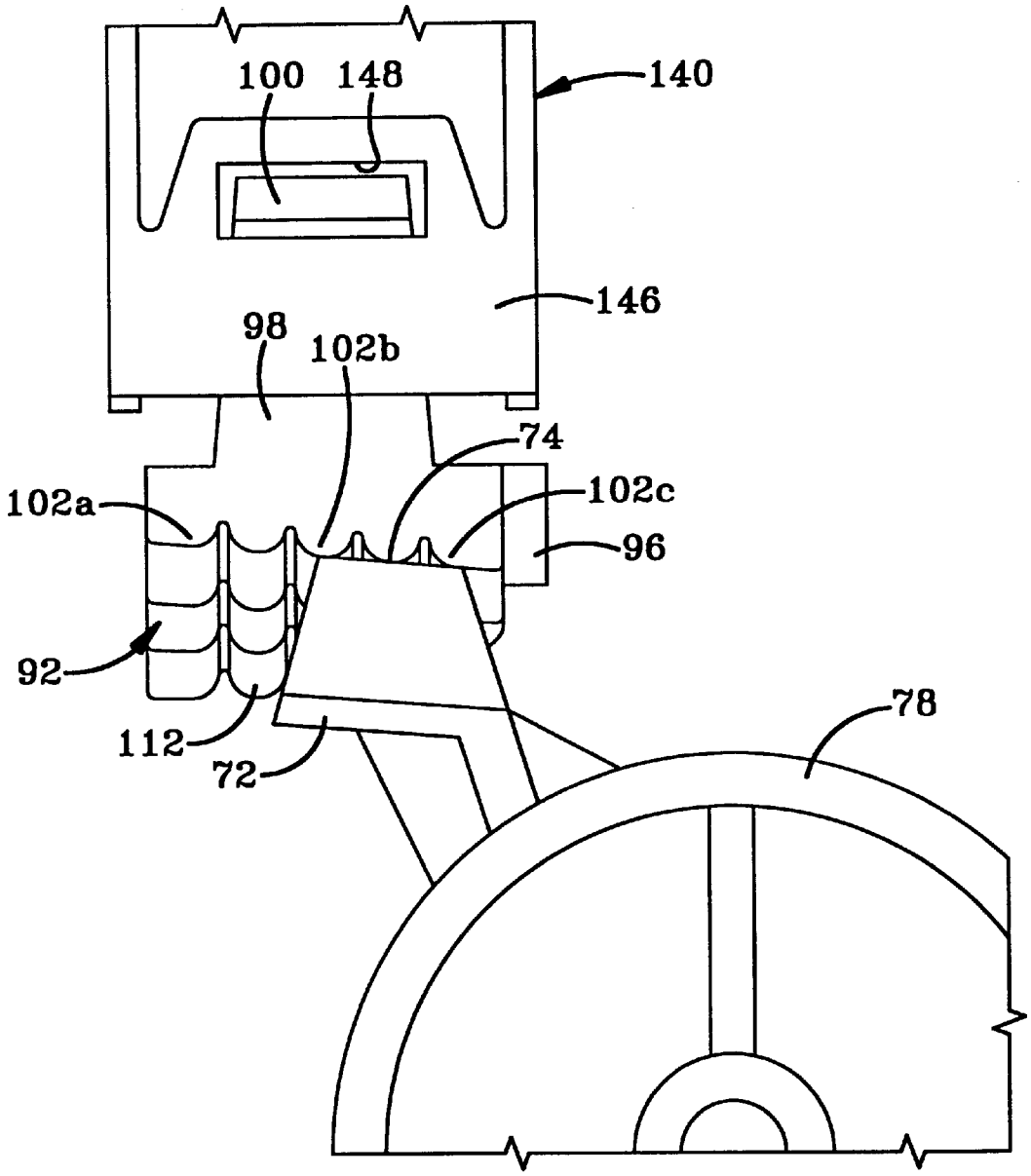
FIG. 11 is a greatly enlarged side elevational view of the height adjustment cam shown contacting the wheel carriage.

As shown in FIG. 11, nose 72, and particularly outer surface 74 thereof, cams only against the outer surface of ribs 102 producing minimal surface-to-surface contact between height adjustment cam 80 and wheel carriage 62. This minimal surface-to-surface contact creates very little frictional resistance between the two surfaces allowing height adjustment knob 144 to be easily slid in the direction of arrow A with little resistance provided against the sliding movement of height adjustment cam 80 and thus, knob 144.

To further raise foot 22 and nozzle opening 30 thereof, height adjustment knob 144 is further slid or displaced in the direction of arrow A (FIG. 9) to again cam nose 72 against camming surface 92. Nose 72 cams over second raised projection 117 until nose 72 sits within concave third height adjustment surface 118. Wheels 76 move downwardly in the direction of arrow B (FIG. 9) to raise foot 22 and nozzle opening 30 thereof to the third height setting. Nub 96 comes to rest within a third aligned detent (not shown).

To place foot 22 and nozzle opening 30 thereof in the fourth or highest height setting, height adjustment knob 144 is further slid in the direction of arrow A (FIG. 10) to cam nose 72 against camming surface 92. Nose 72 cams over third raised projection 119 until nose 72 sits against fourth height adjustment surface 120. Wheels 76 are further moved in the direction of arrow B raising foot 22 to the fourth height setting. Nub 96 comes to rest within a fourth aligned detent (not shown).

As wheel carriage 62 pivots about pintles 66, the angle between nose 72 and height adjustment cam 80 will vary. The front to rear angled surface of camming surface 92 provides a relatively consistent angular relationship between nose 72 and camming surface 92, and maintains constant and consistent contact between the two members. As height adjustment cam 80 slides from lower end 88 to higher end 89, the angle between nose 72 and height adjustment cam 80 decreases, and thus the front to rear angle of camming surface 92 decreases to compensate for the changing pivotal movement of wheel carriage 62.

Additionally, as nose 72 is moved towards higher end 89 of height adjustment cam 80, nose 72 approaches the rear edge of camming surface 92. Flat outer edge 110 provides a flat surface on which nose 72 cams and prevents nose 72 from riding on a corner edge of height adjustment cam 80.

Accordingly, the rounded outer surface of ribs 102 provides minimal surface-to-surface contact between height adjustment cam 80 and wheel carriage 62. This small area of surface-to-surface contact creates very little friction between the cam and the wheel carriage, thus creating little resistance to the sliding movement of height adjustment knob 144. Height adjustment knob 144 may be easily slid in the direction of arrow A to raise wheels 76 in the direction of arrow B.

Figure 10:
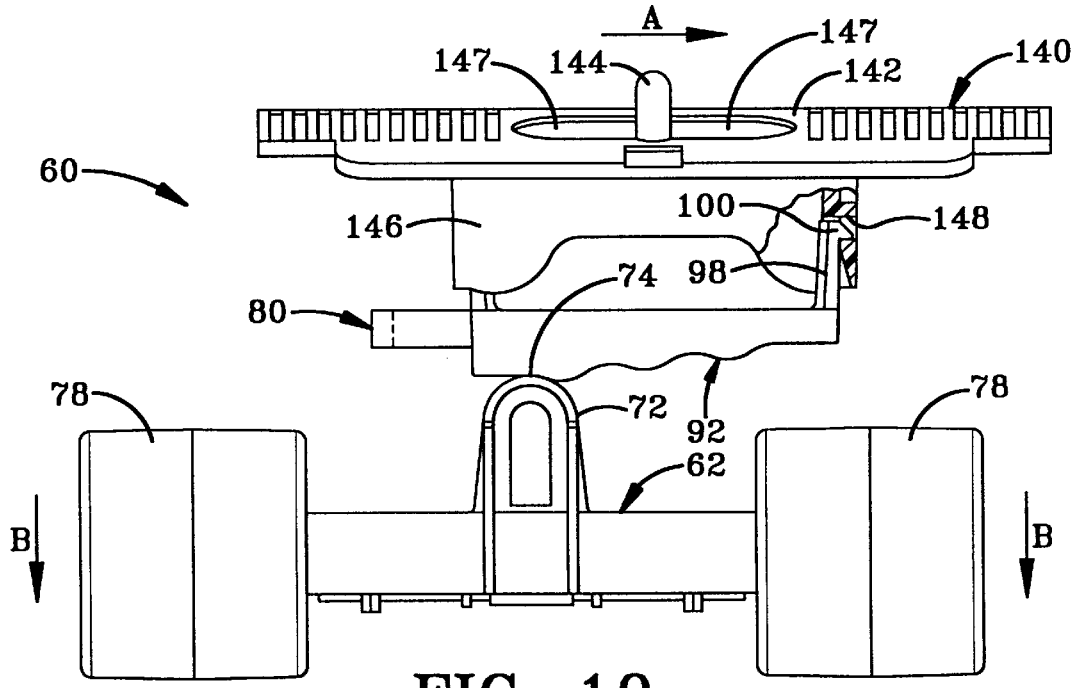
FIG. 10 is a front elevational view similar to FIG. 9 showing the height adjustment mechanism in a fourth height setting.

It is understood, that the same interaction between wheel carriage 62 and height adjustment cam 80 will result when height adjustment knob 144 is slid in a direction opposite that of arrows A to lower wheels 76 in a direction opposite that of arrows B. Although nose 74 will cam down the stepped camming surface 92, nose 74 will have to overcome the slight raise of projections 115, 117 and 119. The minimal surface-to-surface contact (as shown in FIG. 10) allows foot 22 to be easily lowered as well as easily raised relative to the floor surface.

Moreover, camming surface 92 is not limited to being formed on height adjustment mechanisms as shown in the drawings and described herein. Ribbed camming surface 92 may be formed on any height adjustment mechanism which creates a camming action between two members to raise or lower the height of the vacuum cleaner nozzle opening relative to a floor surface. With any height adjustment mechanism, ribbed camming surface 92 will reduce the area of surface-to-surface contact between two members, thus reducing the friction created between the two members and providing an easily adjustable height adjustment mechanism. Further, it is understood that height adjustment cam 80, and specifically ribbed camming surface 92 thereof may be retrofit to existing cleaners by merely replacing the existing height adjustment cam with a height adjustment cam formed with ribbed camming surface 92.

Accordingly, the improved vacuum cleaner height adjustment mechanism is simplified, provides an effective, inexpensive, and efficient device which achieves all of the enumerated objectives. While there has been shown and described herein a preferred embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. An improved height adjustment mechanism for a vacuum cleaner, said vacuum cleaner including a foot formed with a nozzle opening, a height of said foot being adjustable relative to a surface being cleaned, said height adjustment mechanism including a wheel carriage which engages the surface and supports the foot thereon, said wheel carriage being movable to adjust the height of the foot, and a height adjustment cam movably mounted on the foot and having a camming surface for engaging the wheel carriage, the improvement comprising:

ribs, having a length extending in a first direction, formed along at least one of the camming surface of the height adjustment cam and the wheel carriage for decreasing the surface-to-surface contact therebetween when said height adjustment cam is moved in the direction of said length.

2. The improved height adjustment mechanism defined in claim 1 in which the ribs are formed along a direction of motion of the height adjustment cam.

3. The improved height adjustment mechanism defined in claim 1 in which at least one of the height adjustment cam and wheel carriage is formed of a low friction material.

4. The improved height adjustment mechanism defined in claim 3 in which the low friction material is acetal.

5. The improved height adjustment mechanism defined in claim 1 in which certain of the ribs are formed with a curved outer surface which provides the surface-to-surface contact between the height adjustment mechanism and the wheel carriage.

6. The improved height adjustment mechanism defined in claim 1 in which grooves are formed between the ribs.

7. The improved height adjustment mechanism defined in claim 1 in which the ribs are formed on a bottom of the height adjustment cam.

8. The improved height adjustment mechanism defined in claim 7 in which the camming surface is sloped downwardly from a front to a rear of the height adjustment cam.

9. The improved height adjustment mechanism defined in claim 8 in which the camming surface is stepped upwardly from a lower end of the height adjustment cam to a higher end of the height adjustment cam.

10. A height adjustment mechanism for a suction nozzle of a vacuum cleaner, said height adjustment mechanism including:

a wheel carriage pivotally mounted to the suction nozzle for supporting said suction nozzle on a floor surface;

a height adjustment cam displaceable on said suction nozzle, said height adjustment cam having a camming surface which engages the wheel carriage to cammingly pivot the wheel carriage relative to the nozzle when said height adjusting cam is displaced, to thereby adjust the height of said nozzle above a floor surface; and wherein at least one of the height adjustment cam and wheel carriage is formed with a plurality of ribs having a length extending in a First direction for reducing the surface-to-surface contact therebetween when said height adjustment cam is moved in the direction of said length.

11. The height adjustment mechanism defined in claim 10 in which the ribs are formed along a direction of travel of the height adjustment cam.

12. The height adjustment mechanism defined in claim 10 in which the height adjustment cam is formed of a low friction plastic material.

13. The height adjustment mechanism defined in claim 10 in which certain of the ribs are formed with a curved outer surface which provides the surface-to-surface contact between the height adjustment mechanism and the wheel carriage.

14. The height adjustment mechanism defined in claim 10 in which the camming surface is stepped upwardly from a lower end of the height adjustment cam to a higher end of the height adjustment cam.

15. The height adjustment mechanism defined in claim 10 in which the camming surface is sloped downwardly from a front to a rear of the height adjustment cam.

16. A device for elevating and lowering a vacuum cleaner nozzle relative to a support surface, said device including:

a height adjustment cam which is displaceable to elevate and lower the vacuum cleaner nozzle, said height adjustment cam having a camming surface comprised of a plurality of surfaces having a length in a first direction separated by grooves for reducing the amount of force required for elevating and lowering the vacuum cleaner nozzle when said height adjustment cam is moved in the direction of said length.

17. The height adjustment mechanism defined in claim 16 wherein the plurality of surfaces are formed along a direction of motion of the height adjustment cam.

18. The height adjustment mechanism defined in claim 16 wherein certain of the plurality of surfaces are formed with a curved outer surface.

* * * * *